United States Patent [19]

Moore

[11] Patent Number: 4,673,343

[45] Date of Patent: Jun. 16, 1987

[54] ROTARY VANE PUMP

[76] Inventor: Jesse C. Moore, 309 S. Portland St., Celina, Ohio 45822

[21] Appl. No.: 822,374

[22] Filed: Jan. 27, 1986

Related U.S. Application Data

[63] Continuation-in-part of Ser. No. 600,281, Apr. 13, 1984, Pat. No. 4,568,257.

[51] Int. Cl.[4] ..... F04C 2/46; F04C 18/46

[52] U.S. Cl. ..... 418/173; 418/185; 418/187

[58] Field of Search ..... 418/173, 185, 187, 188

[56] References Cited

U.S. PATENT DOCUMENTS

| | | | |
|---|---|---|---|
| 917,944 | 4/1909 | Hoffman | 418/173 |
| 983,754 | 2/1911 | Nichols | 418/184 |
| 1,352,107 | 9/1920 | Wagenhorst | 418/185 |
| 1,390,932 | 9/1921 | Shiner | 418/173 |
| 1,719,954 | 7/1929 | Wilson | 418/185 |
| 1,851,193 | 3/1932 | Laraque | 418/173 |
| 1,941,651 | 1/1934 | Behlmer | 418/185 |
| 2,102,346 | 12/1937 | Wishart | 418/173 |
| 2,246,274 | 6/1941 | Davidson | 418/173 |
| 2,316,318 | 4/1943 | Davidson | 418/188 |
| 2,891,482 | 6/1959 | Menon | 418/173 |
| 2,969,743 | 1/1961 | Menon | 418/173 |
| 3,298,331 | 1/1967 | Butler | 418/187 |
| 3,697,203 | 10/1972 | Butler | 418/173 |
| 4,003,682 | 1/1977 | Stein | 418/173 |

*Primary Examiner*—John J. Vrablik

*Attorney, Agent, or Firm*—Jacox & Meckstroth

[57] ABSTRACT

A rotary vane pump comprising an inner rotor and an outer rotor which rotate together about eccentric axes. A pair of support shafts are attached to the inner rotor and are rotatably mounted for rotation of the inner rotor. At least one of the support shafts is hollow and serves as a fluid conduit. The outer rotor is rotatably mounted upon the support shafts. The outer rotor and the inner rotor are provided with ports at the ends thereof for flow of fluid into the inner rotor. The relative dimensions of the rotors is such that a chamber is formed between the rotors. A vane is attached to the outer rotor and slidably extends into a slot in the inner rotor. The vane divides the chamber into intake and outlet portions. Fluid flows from the inner rotor into the chamber between the rotors, and fluid flows from the chamber into fluid conduit formed by the hollow support shaft.

12 Claims, 8 Drawing Figures

ROTARY VANE PUMP

RELATED APPLICATION

This application is a continuation-in-part of patent application Ser. No. 600,281, filed Apr. 13, 1984, now U.S. Pat. No. 4,568,257.

BACKGROUND OF THE INVENTION

Numerous rotary vane pumps have been devised for pumping fluids. However, most of the known rotary vane pumps have been found to be relatively inefficient in operation and complex in structure. Known rotary vane pumps also are subject to excessive wear of the moving parts. Known rotary vane pumps do not have good seal characteristics between moving parts.

It is therefore an object of this invention to provide a rotary vane pump which is efficient in operation, and which does not have parts which wear excessively.

It is another object of this invention to provide such a rotary vane pump in which "back-flow" does not occur.

Another object of this invention is to provide such a rotary vane pump in which the bearings are readily accessible for inspection.

It is another object of this invention to provide such a rotary vane pump which can be produced and operated at relatively low costs.

Other objects and advantages of this invention reside in the construction of parts, the combination thereof, the method of production and the mode of operation, as will become more apparent from the following description.

SUMMARY OF THE INVENTION

This invention comprises a rotary pump for pumping fluids, hydraulic or gas. The rotary pump comprises an inner rotor and an outer rotor which rotate together about eccentric axes. The outer rotor comprises a cylindrical enclosure within which the inner rotor is positioned. A vane is attached to the inner surface of the outer rotor and slidably extends into a slot in the inner rotor. Due to the fact that the inner rotor and the outer rotor rotate about eccentric axes, there is relative reciprocal lateral movement between the inner rotor and the outer rotor during rotation thereof. There is also reciprocal movement between the inner rotor and the vane during rotation of the rotors.

DETAILED DESCRIPTION OF THE PREFERRED EMBODIMENT

Figure 1:
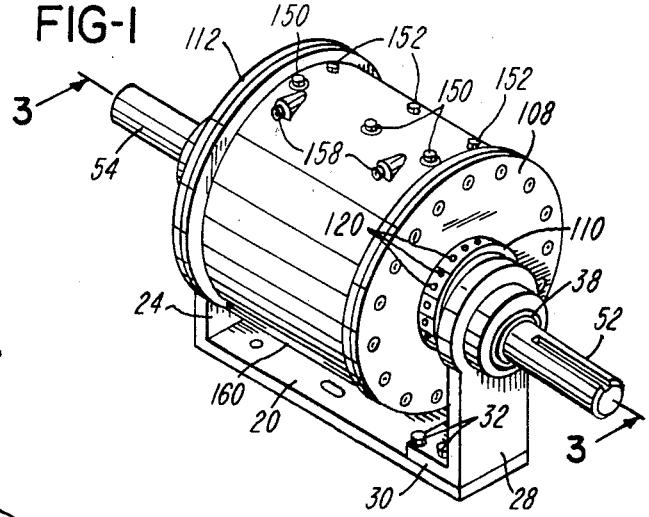
FIG. 1 is a perspective view of a rotary vane pump of this invention.

A rotary vane pump of this invention comprises a base 20, shown herein as being horizontal. The base 20 has a pedestal 24 at one end thereof and a pedestal 28 at the other end thereof. The pedestal 28 is shown as being attached to the base 20 by means of a plate 30 and bolts 32.

The pedestal 28 supports a bearing 38, and the pedestal 24 supports a bearing 40. The pedestal 24 also supports a bearing 44, and the pedestal 28 also supports a bearing 48. The bearings 38 and 40 are coaxial and the bearings 44 and 48 are coaxial. However, the bearing 44 and 48 are not coaxial with the bearings 38 and 40. A shaft 52, shown herein as a solid shaft, extends through the bearing 38 and is rotatably supported thereby. A hollow shaft 54 extends through the bearing 40 and is rotatably supported thereby. The shafts 52 and 54 have flanges 56 and 58, respectively, which are attached to an inner rotor 60 and support the inner rotor 60. The inner rotor 60 has opposed end walls 61 and 63. The flange 56 of the shaft 52 is attached to the end wall 61, and the flange 58 of the shaft 54 is attached to the end wall 63. The flange 58 has openings 66 therein.

Between the flange 56 of the shaft 52 and the fange 58 of the shaft 54, the inner rotor 60 has a shaft 68 provided with a passage 70. A portion of the passage 70 is shown as having an elongate cylindrical wall and a portion of the passage 70 comprises a slot 70*a* having substantially straight parallel walls.

The inner rotor 60 has a chamber 76 therein. A radially extending wall 80 attaches the shaft 68 to the outer portion of the inner rotor 60. The wall 80 extends substantially the length of the inner rotor 60. Within the wall 80 is a slot 84, shown in FIG. 2, which extends substantially the length of the inner rotor 60. Extending through the end wall 61 and encompassing the flange 56 of the shaft 52 is a plurality of orifices 86, arranged in an annular configuration. Extending through the end wall 63 and encompassing the flange 58 of the shaft 54 is a plurality of orifices 87, arranged in an annular configuration.

Figure 2:
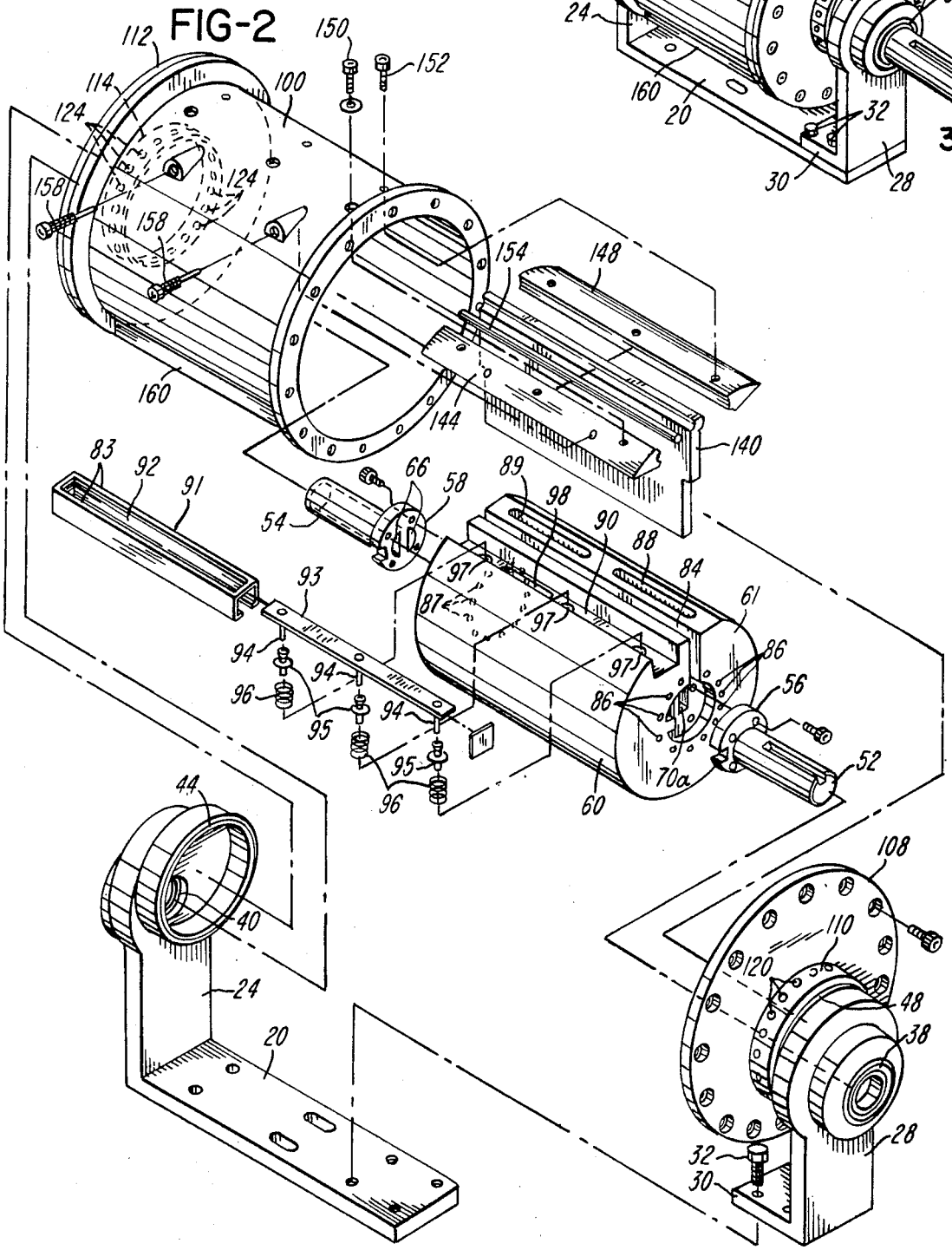
FIG. 2 is an exploded perspective view of the rotary vane pump, drawn on a larger scale than FIG. 1.
Figure 3:
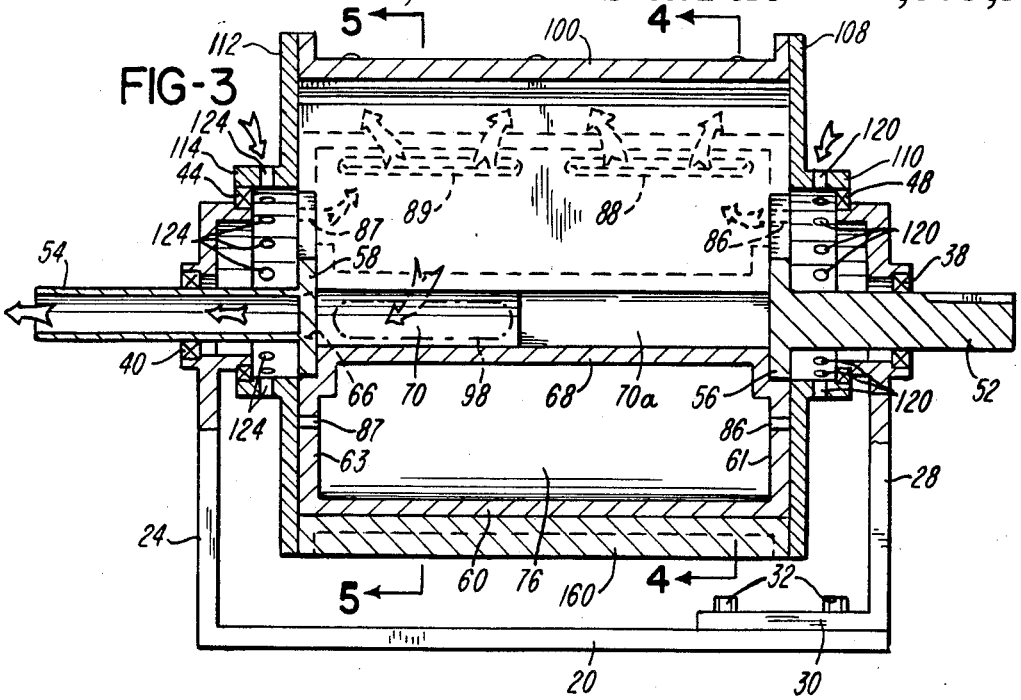
FIG. 3 is a sectional view taken substantially on line 3—3 of FIG. 1 and drawn on a larger scale than FIG. 1.
Figure 4:
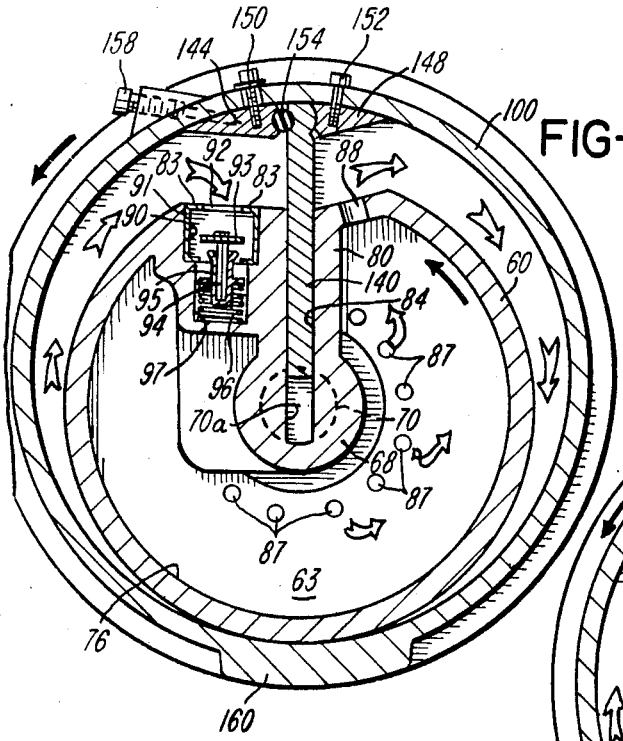
FIG. 4 is a sectional view taken substantially on line 4—4 of FIG. 3.
Figure 5:
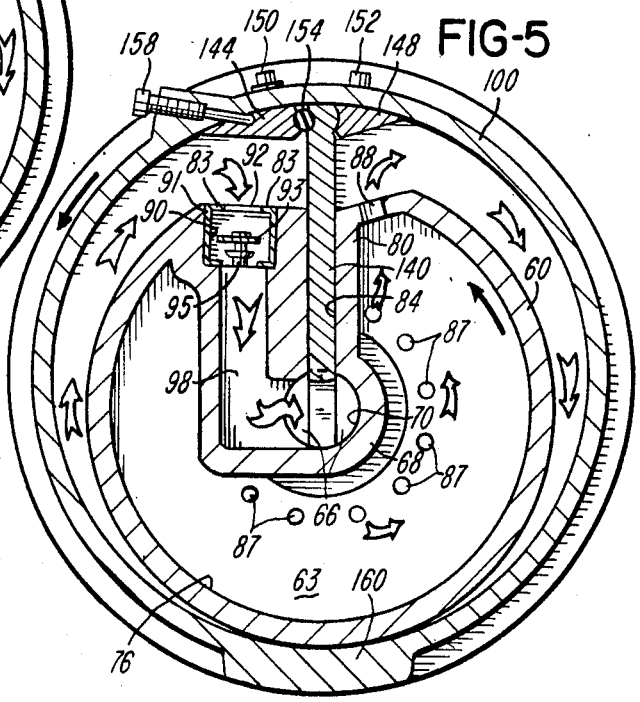
FIG. 5 is a sectional view taken substantially on line 5—5 of FIG. 3.

As shown in FIGS. 2, 4, and 5, the inner rotor 60 has elongate passages 88 and 89, which lead from the periphery of the inner rotor 60 to the chamber 76 therein. The inner rotor 60 has an axially extending peripheral channel 90, within which is an elongate valve member 91 which is secured to the channel 90 of the inner rotor 60. The valve member 91 is provided with a pair of spaced-apart flanges 83 which serve as a valve seat and form an elongate opening 92 in the valve member 91. Mounted within the channel 90 is an elongate movable valve member 93 which has stems 94 attached thereto, as shown in FIG. 2. Sleeve members 95 encompass the stems 94. The sleeve members 95 are urged by spring members 96 toward the flanges 83. The spring members 96 are seated in recesses 97 in the channel 90. Thus, the movable valve member 93 is urged by the spring members 96 toward the elongate opening 92 for closing of the opening 92.

In communication with the channel 90 is a passage 98 which leads to the axially extending passage 70 within the inner rotor 60.

Encompassing the inner rotor 60 is an outer rotor 100. The outer rotor 100 has an end cover 108 at one end thereof which has an annular hub 110 integral therewith. The hub 110 is rotatably supported upon the bearing 48. At the other end of the outer rotor 100 is an end cover 112 provided with a hub 114. The hub, 114 is rotatably supported upon the bearing 44. The annular hub 110 is provided with a plurality of apertures 120 therethrough. The annular hub 114 is provided with a plurality of apertures 124 therethrough.

Attached to the inner surface of the outer rotor 100 is a vane 140. The vane 140 is secured to the outer rotor 100 by means of clamping members 144 and 148, which are retained by screws 150 and 152, respectively. A resilient spacer member 154 is positioned between the clamping member 144 and the vane 140 and permits angular movement of the vane 140 with respect to the outer rotor 100. Screws 158 which engage the clamping member 144 serve as adjustment means. The vane 140 extends into the slot 84 of the inner rotor 60. The vane 140 is slidably positioned within the slot 84 of the inner rotor 60.

Attached to the exterior surface of the outer rotor 100 is a counterweight 160.

OPERATION

Preferably, drive means are attached to the shaft 52 for rotation thereof. Rotation of the shaft causes rotation of the inner rotor 60. Due to the fact that the vane 140 is attached to the outer rotor 100 and extends into the inner rotor 60, rotation of the inner rotor 60 causes rotation of the outer rotor 100. For purposes of description of the operation, the rotors 60 and 100 are shown as rotating in a counter-clockwise direction, as illustrated in FIGS. 4–8.

Due to the fact that the inner rotor 60 and the outer rotor 100 do not rotate upon concentric axes, there is lateral movement between the outer rotor 100 and the inner rotor 60 during rotation thereof. Thus, during rotation of the outer rotor 100 and the inner rotor 60 there is relative movement between the vane 140 and the inner rotor 60.

The apparatus of this invention shown herein may be positioned within a space filled with air, or the apparatus of this invention shown herein may be positioned within a space filled with any other fluid, either a liquid or a gas.

As the outer rotor 100 and the inner rotor 60 rotate, fluid flows into the hub 110 through the apertures 120 in the hub 110 and through the apertures 124 in the hub 114. The fluid then flows into the inner rotor 60 through the orifices 86 and 87.

Figure 6:
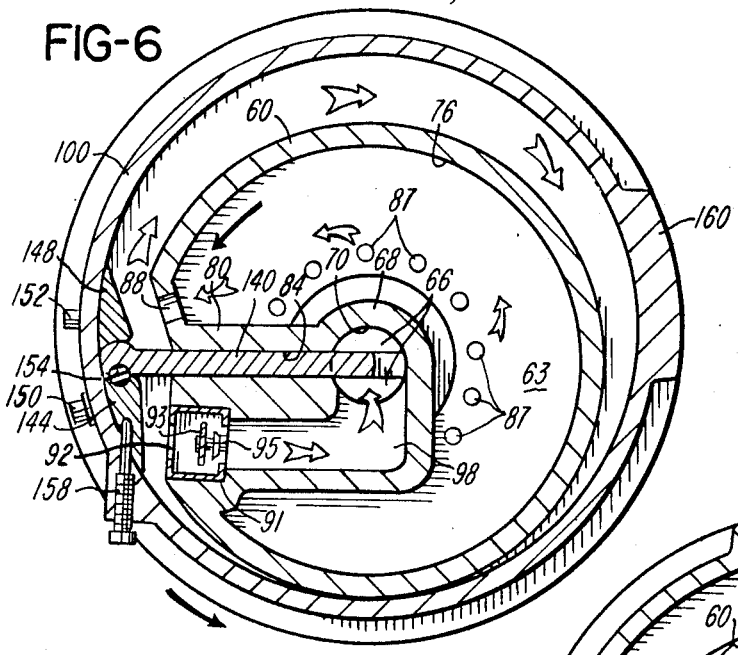
FIG. 6 is a sectional view taken substantially on line 5—5 of FIG. 3 but illustrating the elements of the rotary vane pump in another position of operation.

As illustrated in FIGS. 4 and 5 the fluid flows into the inner rotor 60 through the orifices 87 and then flows outwardly from the inner rotor 60 through the passages 88 and 89. The fluid thus flows from the inner rotor 60 into a chamber or space between the inner rotor 60 and the outer rotor 100. The fluid flows into the chamber or space between the inner rotor 60 and the outer rotor 100 to the right side of the vane 140, as shown in FIGS. 4 and 5. Then as the inner rotor 60 and the outer rotor 100 continue to rotate in a counter-clockwise direction as viewed in FIG. 6, the chamber or space between the inner rotor 60 and the outer rotor 100 on the right side of the vane 140 increases in volume. Thus, the volume of fluid within this space increases, as fluid flows into this space between the inner rotor 60 and the outer rotor 100, as illustrated in FIG. 6.

Figure 7:
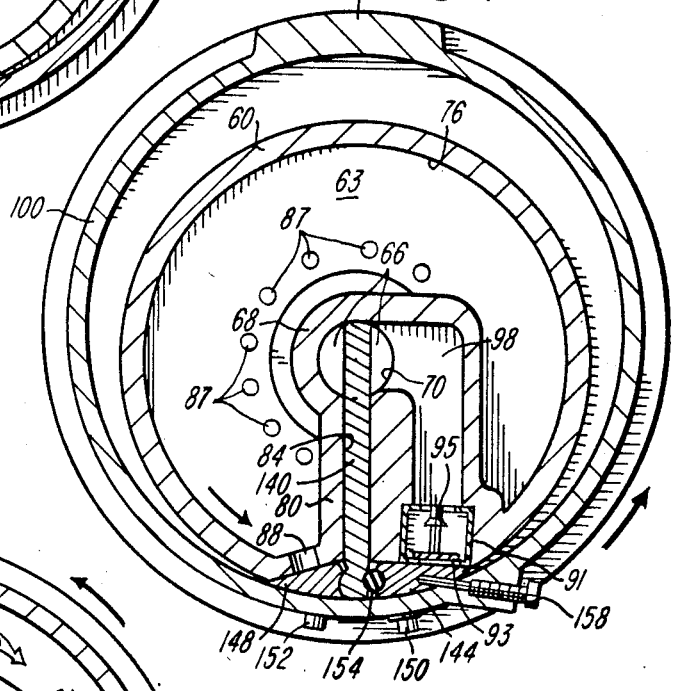
FIG. 7 is a sectional view taken substantially on line 5—5 of FIG. 3 but illustrating the elements of the rotary vane pump in another position of operation.

Then, as the inner rotor 60 and the outer rotor 100 continue to rotate to the position thereof shown in FIG. 7, the space between the inner rotor 60 and the outer rotor 100 is a maximum. At this position of the inner rotor 60 and the outer rotor 100 there is no flow of fluid into the inner rotor 60 and no flow of fluid between the inner rotor 60 and the outer rotor 100.

Figure 8:
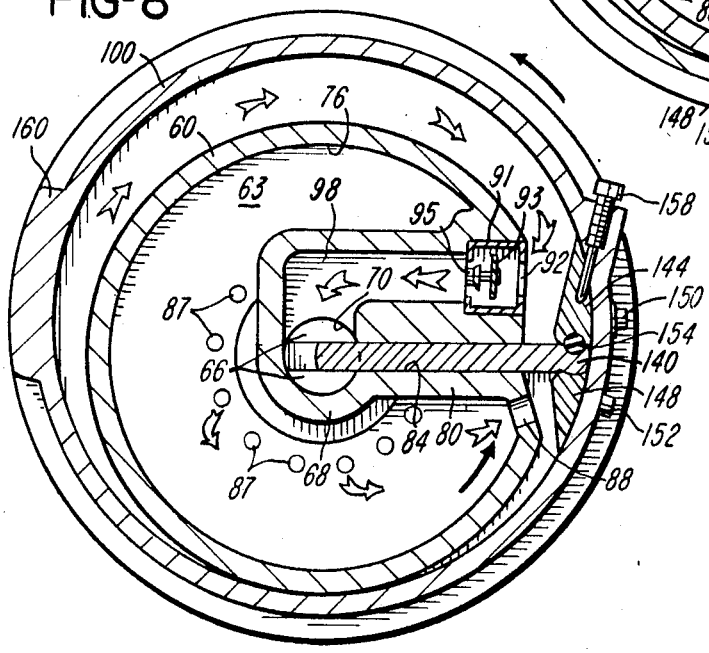
FIG. 8 is a sectional view taken substantially on line 5—5 of FIG. 3 but illustrating the elements in still another position of operation.

Then as the inner rotor 60 and the outer rotor 100 continue to rotate in a counter-clockwise direction as shown in FIG. 8, the space between the inner rotor 60 and the outer rotor 100 to the left of the vane 140 decreases. Thus, the fluid between the inner rotor 60 and the outer rotor 100 to the left of the vane 140 is forced to flow into the passage 98, through the valve member 91. The movable valve member 93 is forced away from the valve seat formed by the flanges 83 in the valve member 91. Thus, fluid flows through the passage 98 into the passage 70, the fluid then flows from the passage 70 into the shaft 54 through the openings 66 in the flange 58. The fluid thus flows outwardly from the shaft 54.

Thus, as the inner rotor 60 and the outer rotor 100 continue to rotate in a counter-clockwise direction, fluid continues to be forced from the openings 66 through the shaft 54, and fluid continues to be drawn into the inner rotor 60 through the openings 120 and 124 in the hubs 110 and 114 and through the orifices 86 and 87. Fluid which flows into the inner rotor 60 through the orifices 86 and 87 flows from the inner rotor 60 into the space between the inner rotor 60 and the outer rotor 100 through the passages 88 and 89, as illustrated in FIGS. 4 and 5.

Thus, it is understood that the pump of this invention is capable of significant volume of fluid flow in consideration of the physical dimensions of the pump.

Although the preferred embodiment of the rotary vane pump of this invention has been described, it will be understood that within the purview of this invention various changes may be made in the form, details, proportion and arrangement of parts, the combination thereof, and the mode of operation, which generally stated consist in a rotary vane pump within the scope of the appended claims.

The invention having thus been described, the following is claimed:

1. A fluid pump comprising:

support means, an inner rotor, the inner rotor having a peripheral surface, the inner rotor also having a cavity therewithin and being substantially hollow, shaft means attached to the inner rotor for rotation therewith, the shaft means rotatably supporting the inner rotor upon the support means, the shaft means including fluid conduit means, an outer rotor encompassing the inner rotor, the outer rotor being substantially hollow and having an inside dimension considerably larger than the outside dimension of the inner rotor, wherein a chamber is formed between the outer rotor and the inner rotor, bearing means rotatably supporting the outer rotor upon the shaft means for rotation of the outer rotor about an axis spaced from the axis of rotation of the inner rotor, the inner rotor having an exterior portion, the outer rotor having an exterior portion, fluid port means within the outer rotor and fluid port means within the inner rotor and positioned adjacent the shaft means, the fluid port means providing fluid communication between the exterior portion of the outer rotor and the cavity within the inner rotor for fluid flow from the exterior portion of the outer rotor to the cavity within the inner rotor, means forming a first passage within the inner rotor, the first passage extending from the cavity of the inner rotor to the exterior portion of the inner rotor for flow of fluid from the cavity of the inner rotor to the chamber between the outer rotor and the inner rotor, conduit means forming a second passage which extends within the inner rotor, the second passage extending between the exterior portion of the inner rotor and the fluid conduit means of the shaft means for flow of fluid from the chamber between the rotors to the fluid conduit means of the shaft means, wall means forming an axially and radially extending slot in the inner rotor, the wall means and the slot extending radially substantially between the periphery of the inner rotor and the axis of rotation thereof, the wall means and the slot extending substantially the axial length of the inner rotor, an axially extending vane within the outer rotor and secured thereto for movement therewith, the vane being positioned within the slot of the inner rotor, the vane extending substantially the axial length of the slot, the vane having a portion movable to and from a position adjacent the axis of rotation of the inner rotor, wherein fluid flows into the cavity of the inner rotor through the fluid port means of the rotors and fluid flows from the cavity through the first passage and into the chamber between the rotors, and wherein the inner rotor and the outer rotor rotate together about eccentric axes and force fluid from the chamber into the conduit means and through the second passage of the inner rotor into the fluid conduit means of the shaft means for flow of fluid from the fluid pump through the shaft means.

2. The fluid pump of claim 1 which includes fluid flow valve means within the second passage permitting flow of only in a direction from the chamber to the fluid conduit means.

3. The fluid pump of claim 1 in which the first passage and the second passage of the inner rotor are adjacent the slot in the inner rotor and in which the slot is positioned between the first passage and the second passage.

4. A fluid pump comprising a base provided with a pair of spaced-apart pedestals, a pair of shafts rotatably supported by the pedestals, at least one of the shafts being a tubular shaft, the tubular shaft having an axial passage therethrough, an inner rotor attached to the shafts and supported thereby and rotatable therewith, the inner rotor having a cavity therein and being substantially hollow, the inner rotor having a peripheral surface, conduit means within the inner rotor forming a first passage which extends from the peripheral surface of the inner rotor to the axial passage through the tubular shaft, the inner rotor being provided with a second passage, the second passage providing communication between the cavity and the peripheral surface of the inner rotor, the peripheral position of the first passage being spaced from the peripheral position of the second passage, an outer rotor rotatably encompassing the inner rotor and supported by the pedestals and rotatable about an axis which is eccentric with the respect to the axis of rotation of the inner rotor, the inner rotor having a smaller diameter than the diameter of the outer rotor so that a chamber is formed between the inner rotor and the outer rotor, wall means within the inner rotor and extending substantially the length of the inner rotor, the wall means also extending radially from the peripheral surface of the inner rotor to a position adjacent the axis of rotation of the inner rotor, the wall means forming a slot which extends radially from the peripheral surface of the inner rotor to a position adjacent the axis of rotation of the inner rotor, the slot also extending axially substantially the length of the inner rotor, the peripheral position of the slot being between the peripheral position of the first passage and the peripheral position of the second passage of the inner rotor, the inner rotor being provided with a pair of opposed end portions, the outer rotor being provided with a pair of opposed end portions, the end portions of the inner rotor and the end portions of the outer rotor being provided with ports which communicate with the cavity within the inner rotor for flow of fluid from the exterior of the outer rotor into the cavity within the inner rotor, a vane within the outer rotor and secured to the outer rotor for movement therewith, the vane extending substantially the length of the inner rotor, the vane being slidably positioned within the slot of the inner rotor and being movable to and from a position adjacent the axis of rotation of the inner rotor, wherein during rotation of the rotors fluid flows into the cavity of the inner rotor through the ports in the rotors and then fluid flows from the cavity through the second passage of the inner rotor and into the chamber between the inner rotor and the outer rotor, the fluid being forced from the chamber through the conduit means and through the first passage of the inner rotor and into the axial passage of the tubular shaft and then through the axial passage.

5. A fluid pump comprising:

an inner rotor, the inner rotor having a cavity therein and being substantially hollow, the inner rotor having a peripheral surface, first support means, the first support means rotatably supporting the inner rotor, the first support means including a hollow shaft which is attached to the inner rotor and which is rotatable with the inner rotor, the hollow shaft forming a fluid conduit, the inner rotor being rotatable about the central axis of the hollow shaft, a substantially hollow outer rotor encompassing the inner rotor, second support means, the second support means encompassing the hollow sahft, the second support means being rotatably supported upon the first support means, means joining the second support means to the outer rotor, the second support means being positioned with respect to the first support means for rotation of the outer rotor about an axis eccentric with respect to the axis of rotation of the inner rotor, the inner rotor having a peripheral surface, conduit means within the cavity of the inner rotor and forming a first passage within the cavity of the inner rotor and extending between the peripheral surface of the inner rotor and the fluid conduit of the hollow shaft, valve means positioned within the first passage and permitting flow of fluid only in a direction from the peripheral surface of the inner rotor to the fluid conduit of the hollow shaft, means forming a second passage within the inner rotor, the second passage providing communication between a cavity of the inner rotor and the peripheral surface of the inner rotor, the inner rotor having a pair of opposed end portions, the outer rotor having a pair of opposed end portions, fluid port means within end portions of the inner rotor and fluid port means within end portions of the outer rotor and adjacent the axis of rotation thereof, the fluid port means providing fluid communication between the end portions of the outer rotor and the cavity of the inner rotor, radially extending guide means within the cavity of the inner rotor, a vane attached to the outer rotor and slidably positioned within the guide means of the inner rotor, the vane being secured to the outer rotor for movement with transverse movement with the outer rotor, the vane extending radially within the cavity of the inner rotor and having a portion movable to and from a position adjacent the axis of rotation of the inner rotor, the vane extending axially substantially between the end portions of the inner rotor, the inside dimension of the outer rotor being greater than the outside dimension of the inner rotor, wherein a chamber is formed between the inner rotor and outer rotor, and wherein the outer rotor and the inner rotor rotate together and wherein there is relative transverse movement between the inner rotor and the outer rotor during rotation thereof, wherein fluid flows into the cavity of the inner rotor through the fluid port means, and wherein fluid flows from the cavity through the second passage and into the chamber between the inner rotor and the outer rotor, and wherein fluid is forced from the chamber into the first passage formed by the conduit means and into fluid conduit of the hollow shaft as the rotors rotate and as reciprocal transverse movement between the inner rotor and outer rotor occurs.

6. The fluid pump of claim 5 in which the inner rotor is provided with a slot within which the vane is positioned, and in which the slot is in fluid communication with the passage through the hollow shaft.

7. The fluid pump of claim 5 in which the outer rotor includes a hub rotatably supported upon the hollow shaft, the hub being provided with a plurality of fluid ports which lead to the inner rotor and in which the inner rotor is provided with a plurality of fluid ports which are in fluid communication with the fluid ports of the hub and which lead to the cavity within the inner rotor.

8. The fluid pump of claim 5 in which the inner rotor includes a connecting shaft which extends axially through the inner rotor, and which includes means joining the connecting shaft to the hollow shaft, and in which a portion of the connecting shaft forms a conduit which is in fluid communication with the conduit through the hollow shaft.

9. The fluid pump of claim 5 in which the inner rotor includes a connecting shaft which extends axially through the inner rotor, and which includes means joining the connecting shaft to the hollow shaft, and in which a portion of the connecting shaft forms a conduit which is in fluid communication with the fluid conduit through the hollow shaft and in which the connecting shaft has an opening therein into which the vane is movable.

10. The fluid pump of claim 5 in which the inner rotor includes a connecting shaft which extends axially through the inner rotor, and which includes means joining the connecting shaft to the hollow shaft, and in which a portion of the connecting shaft forms a conduit which is in fluid communication with the conduit through the hollow shaft and in which a portion of the connecting shaft has a slot therein into which the vane is movable.

11. The fluid pump of claim 5 in which the inner rotor includes a connecting shaft about which the inner rotor rotates and which includes means connecting the connecting shaft to the hollow shaft, the fluid pump including a solid shaft which is connected to the connecting shaft and upon which the outer rotor is rotatably supported.

12. The fluid pump of claim 5 in which the first support means includes a solid shaft, means attaching the solid shaft to one of the end portions of the inner rotor for support thereof during rotation thereof, the hollow shaft being attached to the opposite end portion of the inner rotor.

* * * * *